US011098621B2

(12) United States Patent
Tilbury

(10) Patent No.: US 11,098,621 B2
(45) Date of Patent: Aug. 24, 2021

(54) OIL SUMP ASSEMBLY WITH AN INTEGRATED OIL FILTER

(71) Applicant: Ford Global Technologies LLC, Dearborn, MI (US)

(72) Inventor: Robert John Tilbury, Clifton Springs (AU)

(73) Assignee: Ford Global Technologies, LLC, Dearborn, MI (US)

( * ) Notice: Subject to any disclaimer, the term of this patent is extended or adjusted under 35 U.S.C. 154(b) by 404 days.

(21) Appl. No.: 15/976,178

(22) Filed: May 10, 2018

(65) Prior Publication Data

US 2019/0032526 A1 Jan. 31, 2019

(30) Foreign Application Priority Data

Jul. 28, 2017 (CN) ..... 201710630343.X

(51) Int. Cl.
*F01M 11/00* (2006.01)
*F01M 11/04* (2006.01)

(52) U.S. Cl.
CPC ..... *F01M 11/0004* (2013.01); *F01M 11/0408* (2013.01); *F01M 2011/0029* (2013.01)

(58) Field of Classification Search
None
See application file for complete search history.

(56) References Cited

U.S. PATENT DOCUMENTS 788,833 A * 5/1905 Jackson ..... B01D 35/12 210/102
1,055,744 A * 3/1913 Hans ..... B01D 35/005 210/305
1,671,391 A * 5/1928 Winslow ..... B01D 35/02 184/106
1,677,118 A * 7/1928 Ford ..... B01D 29/23 210/457
1,868,055 A * 7/1932 Edwards ..... F01M 1/10 184/6.24
2,933,188 A * 4/1960 Jacula ..... B01D 35/027 210/172.3
3,189,126 A * 6/1965 May ..... F01M 11/065 184/6.2

(Continued)

FOREIGN PATENT DOCUMENTS

CN 2890360 Y 4/2001
CN 104500167 A 4/2015
CN 105863776 A 8/2016

OTHER PUBLICATIONS http://wardsauto.com/news-analysis/mannhummel-launching-plastic-oil-pan.

(Continued)

*Primary Examiner* — Robert J Popovics
(74) *Attorney, Agent, or Firm* — Geoffrey Brumbaugh; Kolitch Romano LLP

(57) ABSTRACT

An oil sump assembly comprises an oil sump including a first sidewall and a bottom wall for containing oil and an oil filter connected to a bottom portion of the first sidewall of the oil sump. The first sidewall includes a drain hole at the bottom portion and at least a portion of the bottom wall of the oil sump includes a slanted portion sloped towards a bottom of the first sidewall. An oil inlet and an oil outlet of the oil filter face the first sidewall of the oil sump.

6 Claims, 3 Drawing Sheets

(56) References Cited

U.S. PATENT DOCUMENTS 3,707,202 A * 12/1972 Dixon ..... F01M 11/0004 184/6.24
4,043,127 A * 8/1977 Kubik ..... F15B 1/26 60/453
4,139,464 A * 2/1979 Coward ..... F16N 39/06 184/6.24
4,452,695 A * 6/1984 Schmidt ..... B01D 27/08 210/167.05
4,459,208 A * 7/1984 Lemon ..... B01D 29/35 210/167.02
4,519,348 A * 5/1985 Hamilton ..... F01M 11/0004 123/195 C
4,552,662 A * 11/1985 Webster ..... B01D 27/142 210/232
4,595,030 A * 6/1986 Yazaki ..... B01D 17/0214 137/172
4,640,771 A * 2/1987 Whalen ..... B01D 29/15 210/167.01
4,648,363 A * 3/1987 Kronich ..... F02B 63/02 123/196 A
4,662,328 A * 5/1987 Kronich ..... F02B 63/02 123/196 R
4,672,932 A * 6/1987 Schmidt ..... F01M 11/03 123/196 A
4,700,670 A * 10/1987 Schade ..... B01D 35/306 123/196 A
4,733,556 A * 3/1988 Meitzler ..... B01D 27/08 340/631
4,848,293 A * 7/1989 Sasada ..... F01M 11/0004 123/195 C
4,861,467 A * 8/1989 Fukuhara ..... B01D 35/26 210/167.04
4,938,184 A * 7/1990 Martin ..... F01M 11/0004 123/195 C
4,995,971 A * 2/1991 Droste ..... F01M 11/0004 210/167.03
5,000,143 A * 3/1991 Brown ..... F01M 1/12 123/196 S
5,070,831 A * 12/1991 Yunick ..... F01M 11/03 123/196 A
5,139,658 A * 8/1992 Hodge ..... B01D 27/08 210/167.01
5,168,844 A * 12/1992 Waelput ..... B01D 35/306 123/196 A
5,246,086 A * 9/1993 Yunick ..... F01M 11/0458 123/196 A
5,465,692 A * 11/1995 Uraki ..... F01M 11/0004 123/195 C
5,510,023 A * 4/1996 Taylor ..... B01D 29/885 210/180
5,526,782 A * 6/1996 Bedi ..... F01M 11/0458 123/196 A
5,567,306 A * 10/1996 DeWachter ..... B01D 35/306 184/6.24
5,595,152 A * 1/1997 Selby ..... F01M 11/0458 123/196 R
5,601,060 A * 2/1997 Smietanski ..... F01M 11/0004 123/195 C
5,680,833 A * 10/1997 Smith ..... F01P 11/029 123/41.54
5,857,442 A * 1/1999 Sumi ..... F01M 1/02 123/196 CP
5,857,503 A * 1/1999 Vreeken ..... F01M 11/0408 141/1
5,863,424 A * 1/1999 Lee ..... B01D 35/0273 210/167.02
5,934,241 A * 8/1999 Von Esebeck ..... F01M 1/02 123/196 R
5,957,545 A * 9/1999 Sawada ..... B60T 11/26 303/1
5,992,481 A * 11/1999 Smith ..... F01P 11/0204 141/300
6,058,898 A 5/2000 Freese, V
6,116,454 A * 9/2000 Henderson ..... F15B 1/26 137/571
6,217,758 B1 * 4/2001 Lee ..... F01M 11/0004 210/167.06
6,245,232 B1 * 6/2001 Craft ..... B01D 35/306 210/167.08
6,428,699 B1 * 8/2002 Iwata ..... B29C 65/20 210/167.02
6,488,844 B2 * 12/2002 Willis ..... B01D 35/027 184/106
6,517,710 B2 * 2/2003 Hartmann ..... B01D 29/21 210/167.02
6,565,758 B1 * 5/2003 Thomas ..... B64F 5/30 210/776
6,584,950 B1 * 7/2003 Cunningham ..... F01M 11/0004 123/195 C
6,616,836 B1 * 9/2003 Covington ..... B01D 29/016 210/167.02
6,651,777 B2 * 11/2003 Suratt ..... F02B 77/04 123/196 A
6,705,270 B1 * 3/2004 Rau ..... F01M 11/0004 123/195 C
6,715,459 B2 4/2004 Rosendahl et al.
6,790,348 B2 * 9/2004 Orborn ..... B01D 35/027 210/167.08
6,808,575 B2 * 10/2004 Mauelshagen ..... B29C 65/06 156/292
6,827,848 B2 * 12/2004 Covington ..... B01D 29/016 210/167.02
6,849,179 B1 * 2/2005 Taylor ..... B01D 35/027 210/223
6,858,134 B2 * 2/2005 Yates ..... B01D 29/21 210/167.01
6,913,040 B2 * 7/2005 Crossman ..... B01D 29/117 137/587
7,004,206 B2 * 2/2006 Viken ..... B62D 5/062 141/1
7,040,275 B2 * 5/2006 Ohta ..... F01M 11/0004 123/195 C
7,052,378 B2 * 5/2006 Tateiwa ..... B24C 7/0007 451/453
7,093,578 B2 * 8/2006 Batzill ..... F01M 11/0004 123/195 R
7,160,447 B2 * 1/2007 Yates ..... B01D 29/21 210/167.04
7,300,581 B2 * 11/2007 Seipold ..... B01D 35/306 210/232
7,354,511 B2 * 4/2008 Becker ..... B01D 35/0276 137/544
7,387,190 B2 * 6/2008 Lochocki, Jr. ..... F16H 57/0452 184/1.5
7,398,858 B2 * 7/2008 Bicker ..... F01M 11/0004 123/195 C
7,429,322 B2 * 9/2008 Fujita ..... F02M 37/50 210/172.4
7,444,729 B2 * 11/2008 Lochocki ..... F16H 57/0452 29/407.01
7,637,337 B2 * 12/2009 Stranges ..... F01M 11/0004 180/69.1
7,637,966 B2 * 12/2009 Bedetti ..... B01J 2/16 23/313 FB
D641,385 S * 7/2011 Armstrong ..... D15/150
7,992,667 B2 * 8/2011 Rennie ..... F01M 11/03 180/219
8,038,878 B2 * 10/2011 Hewkin ..... F01P 11/06 210/167.32
8,075,772 B2 * 12/2011 Suga ..... B01D 29/96 210/232
8,113,167 B2 * 2/2012 Jessberger ..... F01M 11/0004 123/196 R
8,231,793 B2 * 7/2012 Hacker ..... B01D 35/153 210/767
8,272,480 B2 * 9/2012 Jensen ..... F01M 11/03 184/6.24

(56) References Cited

U.S. PATENT DOCUMENTS 8,312,857 B2 * 11/2012 Jessberger ..... F01M 11/0004 123/195 C
8,336,515 B2 * 12/2012 Jainek ..... F01M 11/0004 123/196 AB
8,486,277 B1 * 7/2013 Nader ..... B01D 35/0273 210/805
8,496,812 B2 * 7/2013 Beer ..... F01M 11/0004 210/167.03
8,561,590 B1 * 10/2013 Spix ..... F01M 11/0004 123/195 C
8,776,757 B2 * 7/2014 Goerend ..... F01M 11/04 123/195 C
8,911,620 B2 * 12/2014 Silegren ..... F01M 11/03 210/175
9,291,310 B2 * 3/2016 Nakazono ..... F02M 37/0082
9,573,085 B2 * 2/2017 Beer ..... B01D 35/005
9,664,077 B2 * 5/2017 Zahdeh ..... F01M 11/0004
9,689,288 B2 * 6/2017 Zahdeh ..... F01M 11/0004
9,802,689 B2 * 10/2017 Hudson ..... F01M 11/12
10,012,117 B2 * 7/2018 Bhosale ..... F01M 11/0004
10,112,136 B2 * 10/2018 Morris ..... B01D 35/0273
10,113,456 B2 * 10/2018 Lee ..... F01M 1/02
10,161,500 B2 * 12/2018 Campbell ..... F01M 11/03
10,408,331 B2 * 9/2019 Altwies ..... F16H 57/042
10,487,861 B2 * 11/2019 Costello ..... F15B 21/041
10,570,788 B2 * 2/2020 Bennett ..... F01M 11/0004
2002/0095763 A1 * 7/2002 Willis ..... B01D 35/027 29/453
2002/0100641 A1 * 8/2002 Osman ..... F01M 11/0004 184/106
2003/0155287 A1 * 8/2003 Osborn ..... B01D 35/027 210/172.1
2004/0026306 A1 * 2/2004 Covington ..... B01D 29/016 210/172.4
2004/0079318 A1 * 4/2004 Batzill ..... F01M 11/0004 123/195 C
2004/0118761 A1 * 6/2004 Yates ..... B01D 35/153 210/172.4
2004/0129368 A1 * 7/2004 Mauelshagen ..... F01M 11/0004 156/73.6
2004/0187931 A1 * 9/2004 Crossman ..... B01D 35/0276 137/549
2004/0256308 A1 * 12/2004 Yates ..... B01D 35/027 210/416.1
2005/0202764 A1 * 9/2005 Tateiwa ..... B24C 7/0007 451/87
2005/0257766 A1 * 11/2005 Rau ..... F01M 11/0004 123/195 C
2006/0000757 A1 * 1/2006 Becker ..... F15B 21/041 210/171
2006/0016741 A1 * 1/2006 Moriyama ..... B60K 15/077 210/172.3
2006/0201864 A1 * 9/2006 Seipold ..... B01D 35/306 210/232
2006/0219620 A1 * 10/2006 Suga ..... B01D 29/01 210/232
2006/0231482 A1 * 10/2006 Khalil ..... B03C 1/286 210/473
2006/0260995 A1 * 11/2006 McCormick ..... B01D 29/23 210/232
2007/0017745 A1 * 1/2007 Rosendahl ..... F01M 11/0004 184/6.24
2007/0023337 A1 * 2/2007 Peet ..... F16H 57/0402 210/136
2008/0028888 A1 * 2/2008 Lochocki, Jr. ..... F16H 57/0452 74/606 R
2008/0078716 A1 * 4/2008 Farmer ..... F01M 11/03 210/433.1
2008/0257625 A1 * 10/2008 Stranges ..... F16H 57/0412 180/69.1
2008/0257649 A1 * 10/2008 Sameck ..... B22D 19/0072 184/106
2009/0057062 A1 * 3/2009 Eschenbeck ..... F16H 61/0031 184/6.28
2009/0127174 A1 * 5/2009 Shinbori ..... B01D 35/0273 210/167.08
2009/0139922 A1 * 6/2009 Poskie ..... B01D 35/0273 210/167.08
2009/0301954 A1 * 12/2009 Beer ..... F16H 57/04 210/167.08
2010/0038296 A1 * 2/2010 Beer ..... F01M 11/0004 210/167.03
2010/0132817 A1 * 6/2010 Hewkin ..... B01D 35/027 137/544
2010/0147253 A1 * 6/2010 Burke ..... F01M 11/0004 123/195 C
2010/0212623 A1 * 8/2010 Jessberger ..... F01M 11/0004 123/196 R
2010/0224450 A1 * 9/2010 Dods ..... F01M 11/0004 184/106
2010/0230212 A1 * 9/2010 Jensen ..... B01D 35/027 184/6.24
2010/0282203 A1 * 11/2010 Jessberger ..... F01M 11/0004 123/195 C
2012/0067807 A1 * 3/2012 Lappeman ..... B01D 21/2483 210/301
2013/0180496 A1 * 7/2013 Murphy ..... F28D 9/005 123/196 A
2013/0199987 A1 * 8/2013 Morris ..... B01D 35/0273 210/323.1
2013/0340706 A1 * 12/2013 Dubos ..... F01M 11/0004 123/196 R
2014/0076433 A1 * 3/2014 Nakazono ..... F02M 37/14 137/565.01
2014/0091023 A1 * 4/2014 Long ..... F16N 7/36 210/167.08
2016/0023622 A1 * 1/2016 Long ..... F16N 39/06 184/6.12
2016/0222845 A1 * 8/2016 Zahdeh ..... F01M 5/001
2016/0245134 A1 * 8/2016 Zahdeh ..... F01M 11/0004
2017/0081008 A1 * 3/2017 Hudson ..... F01M 11/0408
2017/0167330 A1 * 6/2017 Lee ..... F01M 11/0004
2018/0038394 A1 * 2/2018 Costello ..... F15B 21/041
2018/0252128 A1 * 9/2018 Rossignol ..... B29C 66/242
2018/0274657 A1 * 9/2018 Trimmer ..... B01D 35/306
2019/0032526 A1 * 1/2019 Tilbury ..... F01M 11/0408

OTHER PUBLICATIONS

Mann+hummel Launching Plastic Oil Pan; Wards Auto; Apr. 18, 2008; http//wardsauto.com/news-analysis/mannhummel-launching-plastic-oil-pan.

* cited by examiner

OIL SUMP ASSEMBLY WITH AN INTEGRATED OIL FILTER

RELATED APPLICATION

This application claims the benefit of Chinese Patent Application No.: CN 201710630343.X filed on Jul. 28, 2017, the entire contents thereof being incorporated herein by reference.

FIELD

The present disclosure relates to an oil sump assembly, in particular, relates to an oil sump assembly including an oil filter integrated to an oil sump.

BACKGROUND

An oil sump is usually provided at a bottom of an internal combustion engine to store oil and collect the circulated engine oil or lubricate oil from the engine. The engine oil is used to lubricate the parts of the engine to prevent wear of parts. Further, the engine oil prevents excess wear of the parts, cleans the surfaces and inhibits corrosion among other purposes. The engine oil is usually cleaned by an oil filter before being provided to the engine from the oil sump. In a conventional oil sump assembly, the oil filter is located at a position such that the engine oil in the oil filter is separated with the engine oil in the oil sump, which resulting in additional volume of engine oil. Further, an oil sump plug is included in the oil sump to drain the oil during the oil filter replacement. Additionally, a strainer is used at the oil pick up location. The inventor of the present application has recognized that it is desirable to reduce the oil volume in the oil sump assembly and simplify the oil sump configuration.

SUMMARY

According to one aspect of the present disclosure, an oil sump assembly comprises an oil sump having sidewalls including a first sidewall and a bottom wall and an oil filter connected to a bottom portion of the first sidewall of the oil sump. At least a portion of the bottom wall includes a slanted portion sloped towards a bottom of the first sidewall and adjacent to the first sidewall and the first sidewall includes a drain hole at the bottom portion. An oil inlet hole and an oil outlet hole of the oil filter face the first sidewall of the oil sump.

In one embodiment, a lowest portion of the oil filter is substantially at a same level or below a lowest portion of the bottom wall of the oil sump.

In another embodiment, the oil filter includes a circular sidewall surrounding a central axis substantially parallel to an oil level in the oil sump. The slanted portion of the bottom wall of the oil sump includes an interface connected with the first sidewall, and the interface and a portion of the bottom of the first sidewall of the oil sump are configured to be aligned with the sidewall of the oil filter.

In another embodiment, the slanted portion of the bottom wall has a channel aligned with the oil filter.

In another embodiment, the channel is a portion of a cone.

In another embodiment, a cross section of the channel has an arc shape.

In another embodiment, the oil can be drained from the drain hole during an oil filter replacement.

According to another aspect, an oil sump assembly is provided for an internal combustion engine. The oil sump assembly comprises an oil sump including a first sidewall and a bottom wall and an oil filter connected to the first sidewall. The first sidewall includes an interface region, a drain hole at the interface region and adjacent to the bottom wall, and an oil outlet for a filtered oil and the bottom wall includes a slanted portion sloped down toward a bottom of the first sidewall and configured to direct oil to the drain hole. The oil filter includes a housing formed by a sidewall, a first end wall, a second end wall and a filter medium, and the first end wall includes at least one inlet hole and an outlet hole. The first end wall of the oil filter is connected to the interface region of the first sidewall of the oil sump. The oil enters the oil filter via the drain hole of the oil sump and the inlet hole of the oil filter, flows through the filter medium and exits the oil filter via the outlet hole of the oil filter and the oil outlet of the first sidewall of the oil sump.

In one embodiment, the oil filter is a canister filter and the sidewall of the oil filter has a cylindrical shape.

In another embodiment, a bottom of the interface region of the first sidewall and a cross-section of the slanted portion of the bottom wall connected with the first sidewall have an arc peripheral matching the sidewall of the oil filter, respectively.

In another embodiment, an edge portion of the interface region of the first sidewall includes a circular protrusion and a recess concaved from the circular protrusion. The first end wall of the oil filter and the first sidewall of the oil sump define a space at the interface region. The circular protrusion is connected with the oil filter and the oil fills the space and then enters the oil filter.

In another embodiment, the first sidewall of the oil sump further includes a spigot at a center of the interface region and protruding from the first sidewall toward the oil filter, and the spigot is inserted into the outlet hole of the oil filter, and the filtered oil passes through the spigot and flows out the oil sump.

In another embodiment, the oil sump assembly further comprises a pipe disposed at the first sidewall and inside the oil sump. One end of the pipe is connected to the spigot and another end of the pipe is connected to an oil pump, and the filtered oil flows out the oil sump via the pipe.

In another embodiment, a lowest point of the sidewall of the oil filter is substantially at a same level of or below a lowest point of the bottom wall of the oil sump.

In another embodiment, the slanted portion of the bottom wall includes a channel having a semi-circular shape or the slanted portion is a portion of cone.

In another embodiment, the oil filter is disposed at a middle portion of the first sidewall, the bottom wall includes a first portion and a second portion, wherein the slanted portion is positioned between the first portion and the second portion, the first portion and the second portion are sloped toward the slanted.

In another embodiment, the slanted portion and the drain hole on the first sidewall of the oil sump are configured to drain the oil out the oil sump when needed and the oil is only drained from the drain hole.

In another embodiment, the inlet hole on the first end wall of the oil filter includes a plurality of first inlet holes surrounding the outlet hole.

In another embodiment, the first end wall of the oil filter further includes a bottom inlet hole located at a position corresponding the drain hole of the first sidewall of the oil sump to receive the oil during a normal operation as well as to function to take the oil when the oil is drained during an oil filter replacement In another embodiment, the oil filter is connected to the first sidewall of the oil sump via screw connection, and wherein the oil filter is automatically connected to the pipe of the oil pump once at an assembled position.

The oil sump assemblies of the present disclosure have several advantages. For example, the drain hole of the oil sump assembly has dual functions of directing the oil from the oil sump into the oil filter during a normal operation of the oil sump assembly and draining the oil during the oil replacement, repair or cleaning process and thus a designated drain hole is not needed. Further, the oil filter can be used as a pick-up strainer during the oil is drained from the oil sump. Furthermore, the volume of the oil in the oil filter is combined with the oil in the oil sump and thus result in weight saving.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed oil sump assemblies will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various oil sump assemblies are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
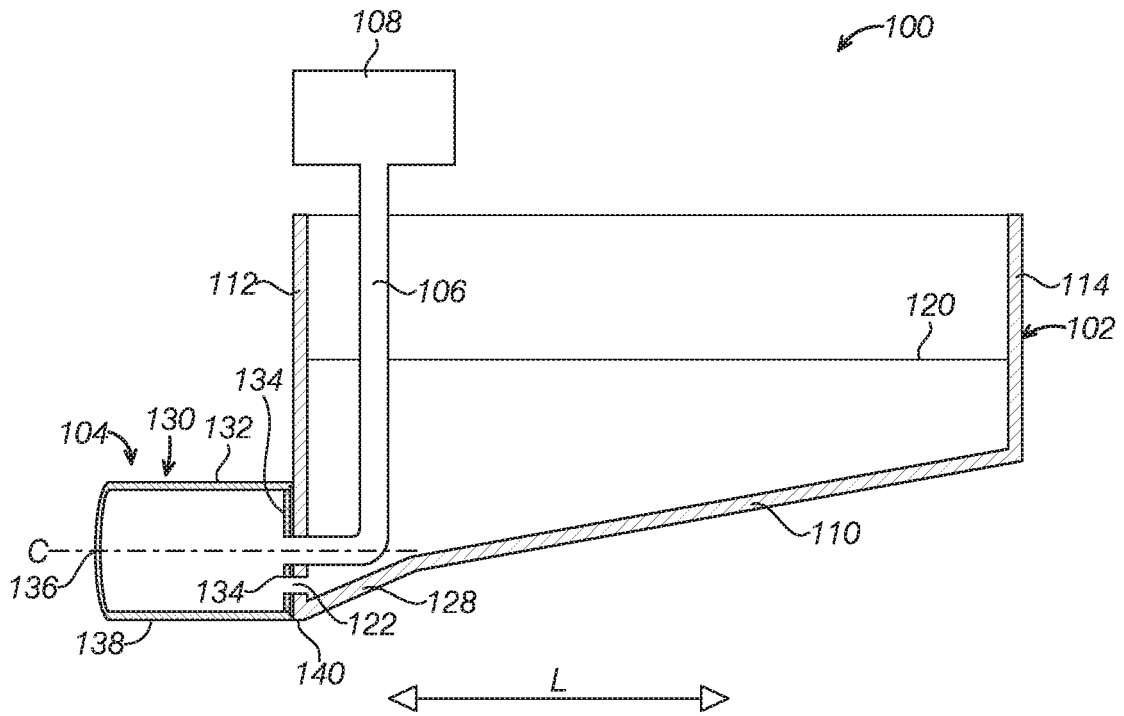
FIG. 1 is a cross-sectional view of an oil sump assembly according to one embodiment of the present disclosure.

FIG. 1 is a cross-sectional view of an oil sump assembly 100 according to one embodiment of the present disclosure. In some embodiments, the oil sump assembly 100 may be used in an internal combustion engine system such as an engine system in a vehicle. The oil sump assembly 100 includes an oil sump 102, an oil filter 104 connected to the oil sump 102, and a pipe 106 connected with the oil filter 104 and an oil pump 108. The oil sump 102 may include a bottom wall 110 and sidewalls extending from a surface of the bottom wall 110. The bottom wall 110 and the sidewalls form a storage space to store engine oil. The oil filter 104 may be connected to a sidewall of the oil sump 102. It will be noted that the engine oil and the oil are used interchangeably in this application. The bottom wall 110 may be configured to be sloped toward in the oil filter 104 so that the oil flows into the oil filter 104 via gravity. The filtered oil flows from the oil filter 104 and leaves the oil sump 102 via the pipe 106 and is delivered to parts of an engine such as an internal combustion engine.

Figure 2:
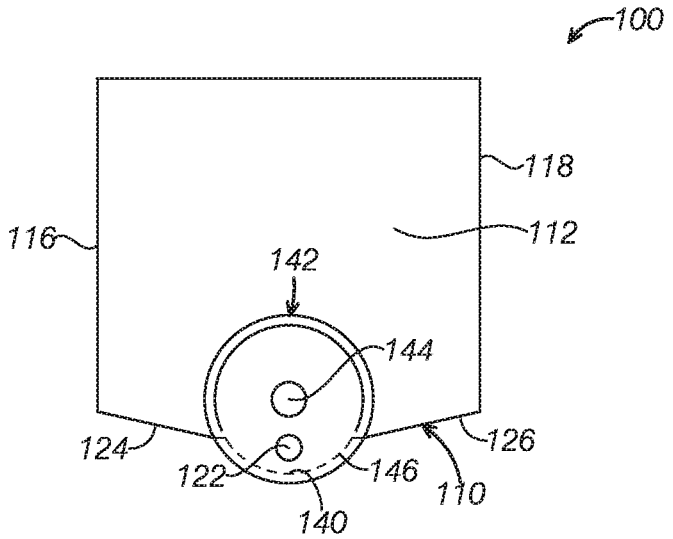
FIG. 2 is a side view of the oil sump assembly in FIG. 1 with an oil filter removed for the clarity of illustration.

Referring to FIGS. 1 and 2, in some embodiments, the oil sump 102 may include a first sidewall 112, a second sidewall 114 opposing the first sidewall 112, and a third sidewall 116 and a fourth sidewall 118 between the first and second sidewalls 112, 114. At a cross section parallel to an oil level 120, the first, second, third, and fourth sidewalls 112, 114, 116 and 118 may have a rectangular shape, or a quadrilateral shape. It should be appreciated that cross section of the oil sump 102 may have any suitable configurations to meet the packaging requirement as well as the volume requirement for the oil.

The bottom wall 110 may be configured to direct the oil toward a drain hole 122 on the first sidewall 112 via gravity and enters the oil filter 104, and may have any appropriate configurations depending on a location of the oil filter 104 on the sidewall of the oil sump 102 and the shape of the oil filter 104. In the embodiment depicted in FIG. 2, the oil filter 104 are positioned in a middle of the bottom wall 110. The bottom wall 110 may include a first portion 124 and a second portion 126 which are sloped toward a middle line dividing the bottom wall 110 to half along a direction L. In other words, the first portion 124 and the second portion 126 are symmetric to the middle line. The bottom wall 110 may further have a slanted portion 128 at the location adjacent to a bottom of the first sidewall 112. The slanted portion is configured to interface with the oil filter 104 and direct an oil flow toward the oil filter 104 connected to the first sidewall 112.

Continuing with FIGS. 1 and 2, the oil filter 104 may include a housing 130 formed by a sidewall 132, a first end wall 134 and a second end wall 136, a filter medium inside the housing 130 (not shown). The first end wall 134 faces the first sidewall 112 of the oil sump 102 and is connected to the first sidewall 112 via any appropriate approaches such as screw connection. A lowest point 138 of the sidewall 132 of the oil filter 104 may be substantially at a same level of a lowest point 140 of the bottom wall 110 of the oil sump 102. In the depicted embodiment, the oil filter 104 may have a cylindrical shape, that is, the oil filter 104 includes a circular sidewall 132 surrounding a central axis C substantially parallel to the oil level 120. A line at bottom of the sidewall 132 may constitute the lowest point 138. The lowest point 140 of the bottom wall 110 of the oil sump may be an intersecting point or section to the bottom of the first sidewall 112. In some embodiments, the lowest point 138 of the sidewall 132 of the oil filter 104 may be lower than a lowest point 140 of the bottom wall 110 of the oil sump 102.

Figure 3:
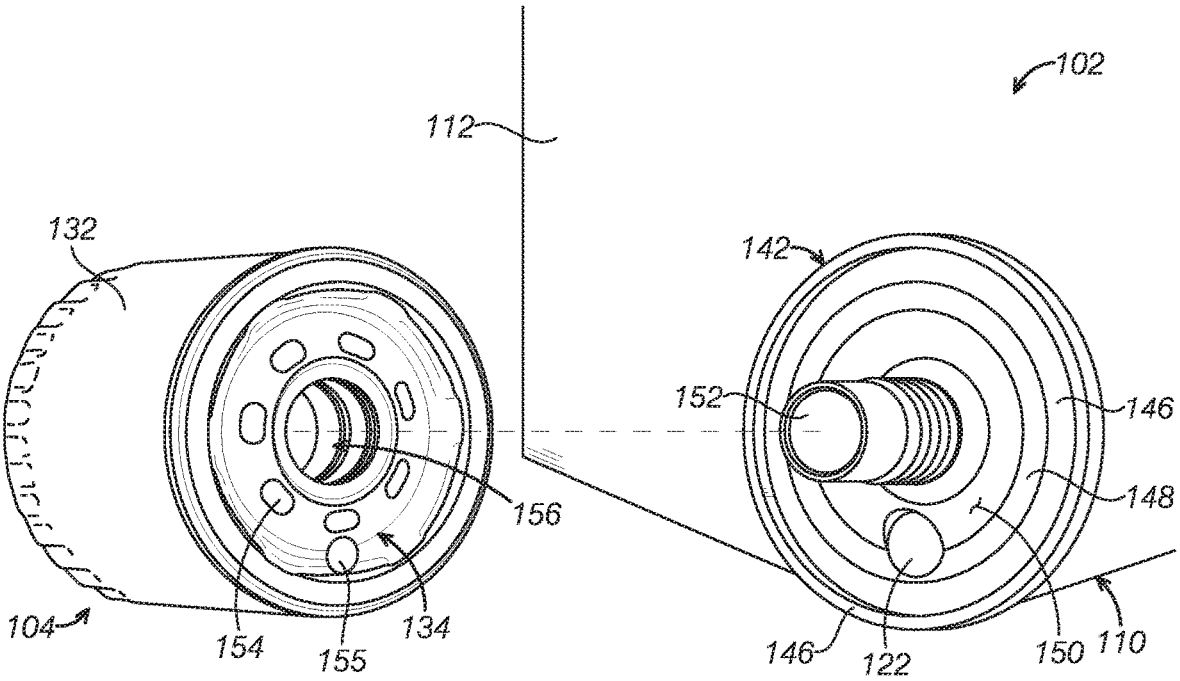
FIG. 3 is an exploded perspective view of the oil sump assembly in FIG. 1, illustrating an interface region between an oil filter and a sidewall of an oil sump.

FIG. 3 is a perspective exploded view of the oil sump assembly in FIG. 1. Referring to FIG. 3 and with further reference to FIG. 2, the first sidewall 112 of the oil sump 102 may include an interface region 142, the drain hole 122 at the interface region 142 and adjacent to or abutting the bottom wall 110, and an oil outlet 144. The slanted portion 128 of the bottom wall 110 includes an interface 146 shown in dash line in FIG. 2. The interface 146 is coupled with the sidewall 132 of the oil filter 104. In some embodiments, the interface 146 of the bottom wall 110 is configured to be aligned with the sidewall 132 of the oil filter 104. In the depicted embodiment, a cross section of the sidewall 132 oil filter 104 is a circular. A cross section of the slanted portion 128 of the bottom wall 110 connected to the bottom of the interface region 142 includes a circular shape or an arc peripheral matching the circular sidewall 132 of the oil filter 104. In some embodiments, an edge portion of the interface region 142 may include a circular protrusion 146 and a recess 148 concaved from a surface of the first sidewall 112. The first end wall 134 of the oil filter 104 and the first sidewall 112 of the oil sump 102 defines a space 150 at the interface region 142. The circular protrusion 146 is connected with the oil filter 104 corresponding a recess on the first end wall 134 in the oil filter 104 to seal the space. Other sealing elements such as a rubber seal may be included in the oiler filter 104 or the interface region 142 to provide tight connection between the oil filter 104 and the interface region 142. In some embodiments, the first sidewall 112 may further include a spigot 152 at a center of the interface region 142. The spigot 152 protrudes from the first sidewall 112, surrounds the outlet 144 and is configured to be inserted into an outlet hole 156 of the oil filter 104.

Continuing with FIG. 3, the first end wall 134 of the oil filter 104 may include at least one inlet hole 154 to allow the oil to flow into the oil filter 104 and an out hole 156 to allow the filtered oil to leave the oil filter 104. In the depicted embodiment, the oil filter 104 includes a plurality of inlet holes 154 surrounding the outlet hole 156. During a process of assembling the oil filter 104 to the oil sump 102, the outlet hole 156 of the oil filter 104 may be aligned with the spigot 152 and then connected with the interface region 142 of the first sidewall 112 via any appropriate approaches such as screw connection or snap fit. One end of the spigot 152 is connected to the pipe 106. That is, the oil filter 104 is automatically connected to the pipe 106 or become fluidically communicated with the oil pump 108 once the oil filter 104 is connected to the oil sump 102. In some embodiments, the oil filter 104 may further include a bottom inlet hole 155 located at a position corresponding the drain hole 122 of the first sidewall 112 of the oil sump to receive the oil during a normal operation as well as to take the oil when the oil is drained during an oil filter replacement.

Figure 4:
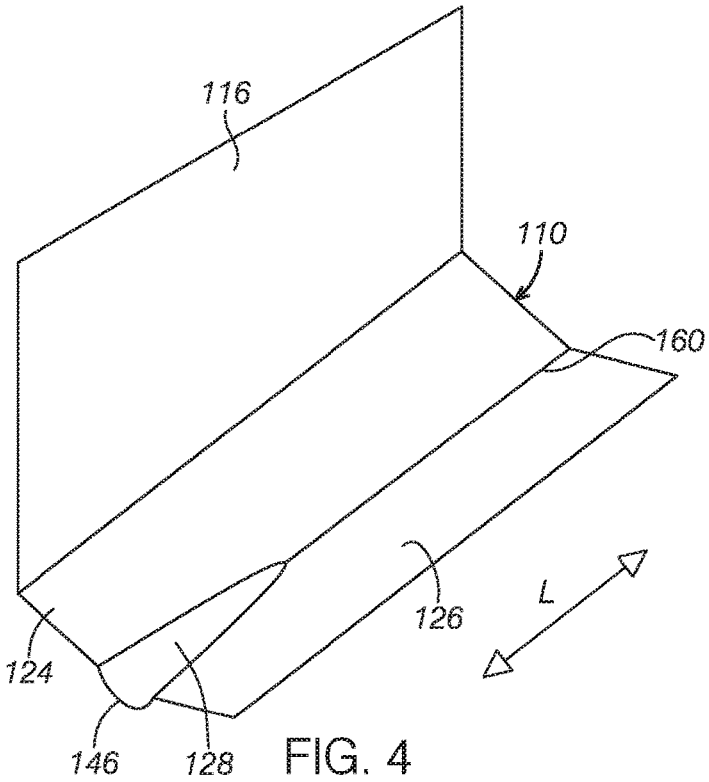
FIG. 4 is a partial perspective view of the oil sump assembly in FIG. 1, illustrating a bottom wall of the oil sump assembly.

FIG. 4 is a schematic diagram showing the sidewall 116 and the bottom wall 110 of the oil sump assembly 100 in FIG. 1. Referring to FIG. 4 and with further reference to FIGS. 1-2, the bottom wall 110 may include a first portion 124 and a second portion 126 that are sloped toward a middle line 160 of the bottom wall 110 and further sloped toward the first sidewall 112. The first portion 124 and the second portion 126 may have a same slope relative to the oil level 120. The bottom wall 110 may further include a slanted portion 128 at the location adjacent to the first sidewall 112. The slanted portion 128 may be a channel configured to be aligned with the oil filter 104. In the depicted embodiment, the slanted portion is a portion of a cone and extends partially along a lengthwise direction L of the bottom wall 110. FIG. 4 also shows that the interface 146 of the bottom wall 110 with the first sidewall 112 has an arc shape to be aligned with a circular sidewall 132 of the oil filter 104. The bottom wall 110 is configured to allow the oil to flow into the drain hole by gravity and substantially drain from the oil sump. It should be appreciated that the bottom wall 110 may have any suitable configuration to meet the packaging requirement in an engine compartment. For example, in another embodiment, the slanted portion 128 may be located between the sidewall 116 and the middle line 160. In other words, a central line of the slanted portion 128 may be located offset the middle line 160 and the corresponding interface region with the oil filter 104 is offset the middle line 160. The first portion 124 and the second portion 126 are not symmetric.

The oil sump 102 may be made from steel, aluminum alloy or plastic and formed in a stamping, casting or molding forming process. The shape of the bottom wall may be formed during the stamping, casting or molding forming process.

Figure 5:
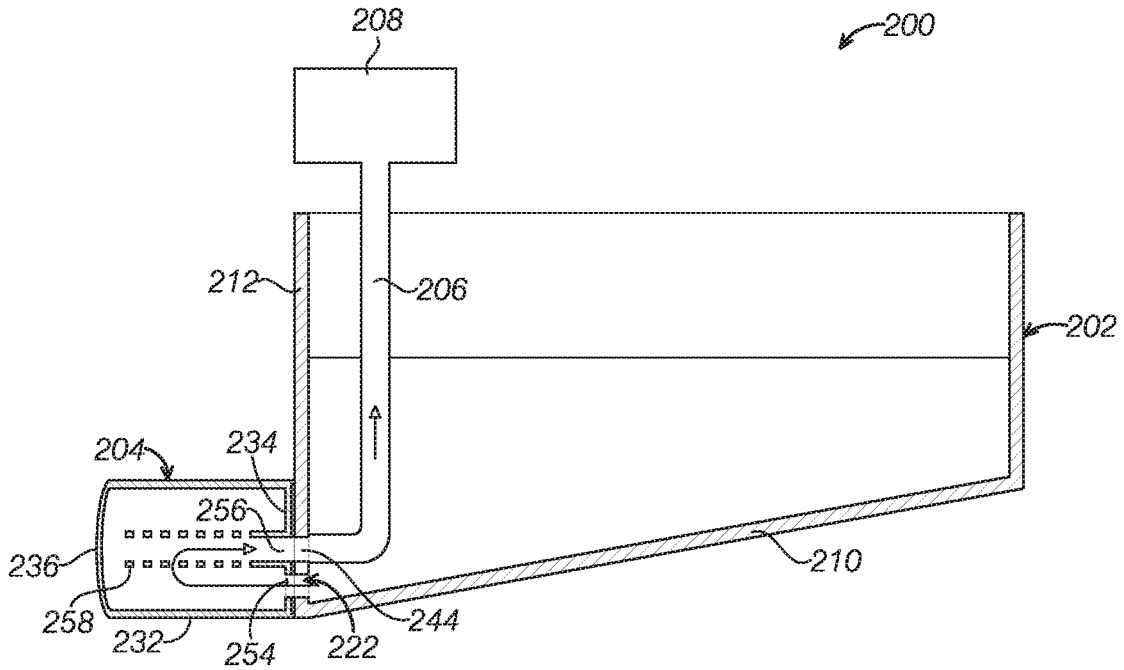
FIG. 5 is a cross-sectional view of an oil sump assembly according to another embodiment of the present disclosure.

FIG. 5 is a cross-sectional view of an oil sump assembly 200 according to another embodiment of the present disclosure. For the sake of brevity, in this example, the elements and features similar to those previously shown and described will not be described in much further detail. The oil sump assembly 200 includes an oil sump 202, an oil filter 204, and a pipe 206 to be connected to an oil pump 208. The oil sump 202 may include a bottom wall 210 and a first sidewall 212 extending from a surface of the bottom wall 210. The first sidewall 212 includes an outlet 244 for the filtered oil to exit the oil filter 204 and entering the pipe 206. The first sidewall 212 further includes a drain hole 222 adjacent to its bottom. The bottom wall 210 is configured to direct the oil toward the drain hole 222 and substantially drain all the oil through the drain hole 222 during an oil filter replacement. In the depicted embodiment, the bottom wall 210 may have a slanted portion sloped toward a bottom of the first sidewall 212 and will describe in detail in association with FIG. 6.

The oil filter 204 may include a circular sidewall 232, a first end wall 234, a second end wall 236 and a filter media 258. In some embodiments, the oil filter 204 may be a canister filter. The first end wall 234 of the oil filter 204 may include an inlet hole 254 connected with the drain hole 222 and an outlet hole 256 connected with the pipe 206. The first end wall 234 of the oil filter 204 is connected with the first sidewall 212 of the oil sump 202.

FIG. 5 further illustrates the oil flow in the oil sump assembly 200 as indicated by an arrowed line. The oil flows into the oil filter 204 via the drain hole 222 and the inlet hole 254, and passes the filter media 258. The filtered oil leaves the oil filter 202 via the outlet hole 256 of the oil filter 204 and an outlet 244 on the first sidewall 212 of the oil sump 202, enters the pipe 206 and then is pumped to the engine by the oil pump 208.

Figure 6:
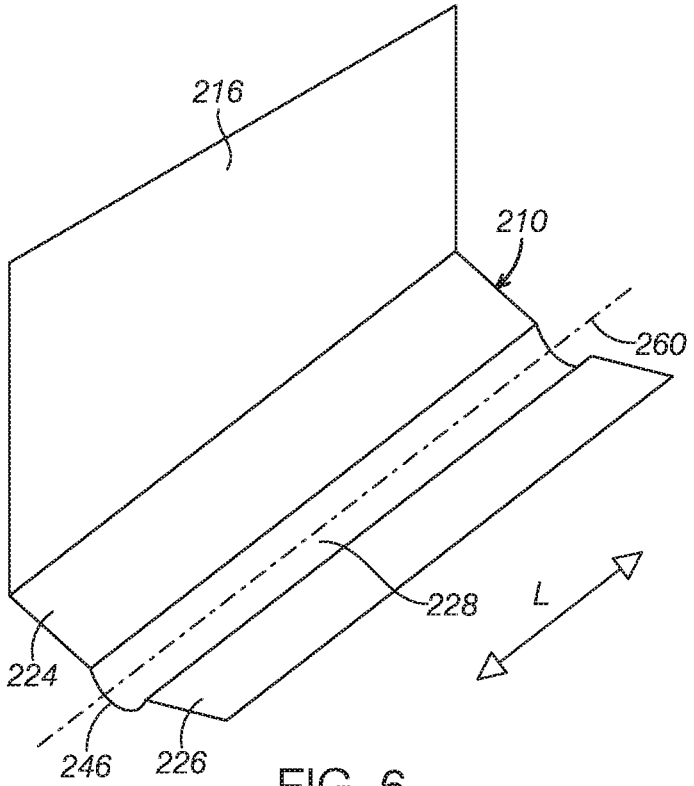
FIG. 6 is a partial perspective view of the oil sump assembly in FIG. 5, illustrating a bottom wall of the oil sump assembly.

FIG. 6 is a schematic view showing a side wall 216 and the bottom wall 210 of the oil sump assembly in FIG. 5. Referring to FIG. 6 and with further reference to FIG. 5, the bottom wall 210 may include a first portion 224 and a second portion 226 that are sloped toward a middle line 260 of the bottom wall 210 and further sloped toward the first sidewall 212 or a place where the oil filter 204 is connected. The bottom wall 210 may further include a slanted portion 228 positioned between the first portion 224 and the second portion 226. The slanted portion 228 may be a channel configured to be aligned with the oil filter 204. In the depicted embodiment, the slanted portion 228 extends along an entire length of the bottom wall 210 at a direction L. The first portion 224, the second portion 226 and the slanted portion 228 may have a same slope relative to the direction L. The cross section of the slanted portion 218 is an arc or the slanted portion 218 is a part of a cylinder. FIG. 6 also shows that the interface 246 with the first sidewall 212 has an arc shape to be aligned with a circular sidewall 232 of the oil filter 204. The configuration of bottom wall 210 allows the oil flows into the drain hole by gravity and substantially drain from the oil sump. It should be appreciated that the bottom wall 210 may have any suitable configuration to meet the packaging requirement in the engine compartment. For example, the slanted portion 228 may be located between the sidewall 216 and the middle line 260. In other words, a central line of the slanted portion 228 may be located offset the middle line 260 and the corresponding interface region with the oil filter 204 is offset the middle line.

The oil sump 202 may be made from steel, aluminum alloy or plastic and formed in a stamping, casting or molding forming process. The shape of the bottom wall may be formed during the stamping, casting or molding forming process.

In the oil sump assemblies of the present disclosure, the oil can be drained through the drain hole at the bottom of the first sidewall of the oil sump. In other words, the drain hole at the bottom of the first sidewall has dual functions of directing the oil from the oil sump into the oil filter during normal operation of the oil sump assembly and draining the oil during the oil replacement, repair or cleaning process. In this way, a designated drain hole like the one used in the conventional oil sump is eliminated. Further, the oil filter can be used as a pick-up strainer during the oil replacement or other processes. The oil filter can collect the remained oil as its inlet hole is at about the lowest point of the oil sump assembly and thus can be served as a strainer.

At an assembled position, the oil in the oil filter 204 is fluidly communicated with the oil in the oil sump 202 and have the same oil level. That is, the oil in the oil filter 204 is a part of oil available to be supplied to the engine. Thus, a volume of oil needed to be maintained in the separate oil filter of a conventional oil sump assembly can be eliminated and reduce the weight of the oil sump assembly.

It should be appreciated that the oil sump assembly of the present application may be used in other machineries besides internal combustion engines. For example, the oil sump assembly can be used on any system that has rotating parts that require lubrication from a volume of oil, such as lathes, grinding and milling machines.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

It will be appreciated that the configurations and routines disclosed herein are exemplary in nature, and that these specific embodiments are not to be considered in a limiting sense, because numerous variations are possible.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. An oil sump assembly, comprising:

an oil sump including:

a slanted bottom wall having a channel terminating in a cone-shaped portion at its lowermost point;

a sidewall attached to said slanted bottom wall and having an exterior interface with a lower drain hole in fluid communication with an interior volume of said cone-shaped portion and an upper filtered oil outlet hole extending through said interface and said sidewall, said interface being adjacent said lowermost point; and a cylindrical oil filter connected to said sidewall at said interface with an outer wall of said cylindrical oil filter dimensionally conforming to an arc defined by said cone-shaped portion, said cylindrical oil filter having an end wall with a bottom inlet hole substantially aligned with said lower drain hole for receiving oil to be filtered and an outlet hole in fluid communication with said upper filtered oil outlet hole for returning filtered oil to an interior of said oil sump.

2. The oil sump assembly of claim 1, further comprising:

a spigot having a hollow interior in fluid communication with said upper filtered outlet hole and protruding from said interface for insertion into said outlet hole of said cylindrical oil filter.

3. The oil sump assembly of claim 2, wherein said outlet hole of said cylindrical oil filter has threads for threadably engaging exterior threads of said spigot.

4. The oil sump assembly of claim 1, wherein opposing sides of said slanted bottom wall are sloped toward said channel at an upper portion of said slanted bottom wall.

5. The oil sump assembly of claim 1, further comprising a pipe fluidically connected to said upper filtered outlet hole for delivering filtered oil to a pump.

6. The oil sump assembly of claim 1, wherein the end wall of the cylindrical oil filter includes a plurality of inlet holes surrounding the outlet hole.

* * * * *